United States Patent [19]

Hara et al.

[11] Patent Number: 4,561,422

[45] Date of Patent: Dec. 31, 1985

[54] HOT AIR TYPE HEATER

[75] Inventors: Masanori Hara, Yokohama; Sakuo Sugawara, Kamakura, both of Japan

[73] Assignee: Mitsubishi Denki Kabushiki Kaisha, Tokyo, Japan

[21] Appl. No.: 675,181

[22] Filed: Nov. 27, 1984

[30] Foreign Application Priority Data

Dec. 13, 1983 [JP] Japan ..... 58-234878
Jan. 26, 1984 [JP] Japan ..... 59-12264

[51] Int. Cl.[4] ..... F24H 3/02

[52] U.S. Cl. ..... 126/110 R; 237/55; 98/32; 98/34.5; 98/34.6; 126/110 E

[58] Field of Search ..... 237/55; 126/110 R, 110 AA, 126/110 D, 110 E; 98/32, 108, 34.5, 34.6

[56] References Cited

U.S. PATENT DOCUMENTS 2,784,659 3/1957 De Roo et al. ..... 98/108
3,057,340 10/1962 Fritts ..... 126/110 E
3,150,657 9/1964 Shultz, Jr. et al. ..... 126/110 E
4,363,314 12/1982 Albertson ..... 126/110 E

FOREIGN PATENT DOCUMENTS 52-152644 12/1977 Japan .
55-38466 3/1980 Japan ..... 126/110 D

*Primary Examiner*—Henry C. Yuen
*Attorney, Agent, or Firm*—Oblon, Fisher, Spivak, McClelland & Maier

[57] ABSTRACT

In a hot air type heating apparatus having two air outlet ports, a temperature of air current blown out of an auxiliary outlet port provided on an outlet port for a high temperature air is rendered to be at a slightly warm temperature level, thereby realizing an improved hot air type heating apparatus capable of distributing warm air to every corner of a large room to effect uniform room warming, and of removing uncomfortableness to a dweller near the heating apparatus owing to a temperature difference caused by the two air currents blown out of the two outlet ports.

18 Claims, 5 Drawing Figures

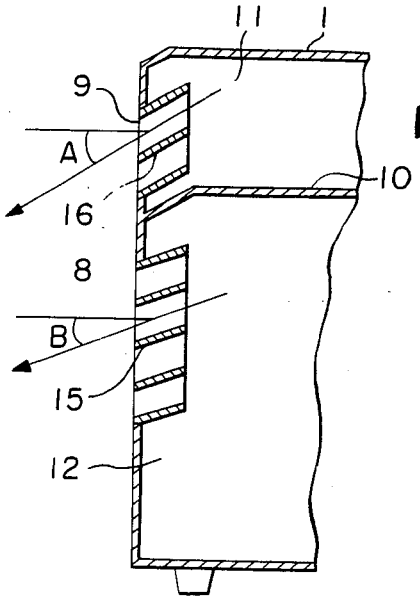
FIGURE 3
FIGURE 5
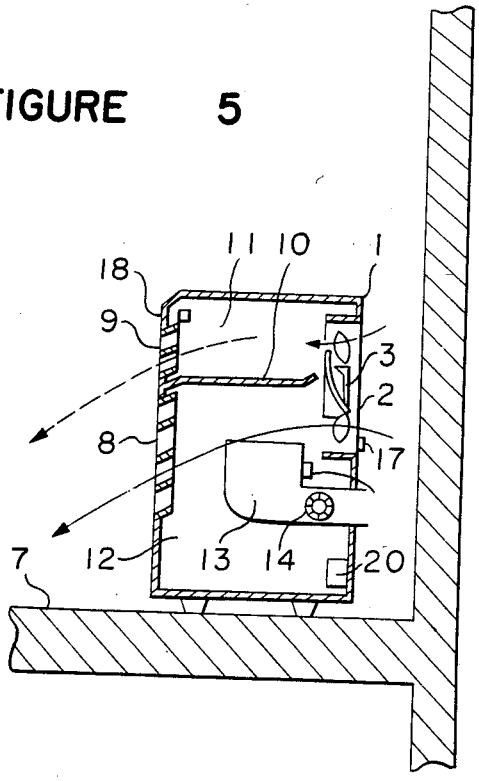

HOT AIR TYPE HEATER

This invention relates to a hot air type heater which aims at improving comfortableness in a room environment.

As this kind of the heater, there has so far been known one as shown in FIG. 1 of the accompanying drawing and as disclosed in Japanese Unexamined Patent Publication No. 152644/1977. In this figure of drawing, a reference numeral 1 designates a casing for a floor type hot air heater, a numeral 2 refers to an inlet port formed in the top surface of this casing 1, a reference numeral 3 represents an air blower provided in the interior of the casing, a numeral 4 refers to a heat-exchanger also provided in the interior of the casing 1, a numeral 5 refers to a first outlet port for blowing out air which has not passed through the heat-exchanger 4, a numeral 6 denotes a second outlet port formed in the bottom-most part of the casing and for blowing out air which has passed through the heat-exchanger, and a numeral 7 refers to a floor.

In the hot air type heater of the above-described construction, most of air in the room interior which has been introduced into the heater through the inlet port 2 thereof by operation of the air blower 3 passes through the heat-exchanger 4 and is blown out of the second outlet port 6 into the room interior as a hot air current. A part of the air in the room interior which has been sucked into the heater through the inlet port 2 is blown out of the first outlet port 5 into the room interior in its state of not being heated nor being reduced its flow rate, i.e., in the state before it passes through the heat-exchanger. As the result of this, the hot air blown out of the second outlet port 6 is suppressed by an air current blown out of the first outlet port 5, having a higher flow rate than that of the hot air and at a temperature same as that of the room interior, whereby the hot air is obstructed its upward movement owing to a difference in the flow rate between the two air currents, and can propagate in the distance on and along the floor surface. However, a dweller who is near the hot air type heater feels a conspicuous temperature difference and temperature changes between his feet and vicinity thereof where hot air as blown out of the heater flows, and his knees and vicinity thereof where air of the same temperature as that of the room interior flows. In addition, since the air current in the vicinity of his knees is at the same temperature as the room temperature, the air current performs the similar function to the wind caused by a fan. That is to say, a person who stands in front of the air current is deprived of his body temperature owing to its air current to thereby feel cool. Thus, for the dweller who is near the conventional hot air type heater, such temperature difference and temperature changes are felt more than the actual temperature difference and the actual temperature changes with the consequent disadvantage such that he would inevitably feel uncomfortableness for the reason of his using the hot air type heater.

The present invention has been made with a view to removing various disadvantages inherent in the conventional hot air type heater as mentioned in the foregoing, and aims at providing a hot air type heater which is capable of distributing hot air to every corner of the room interior, and yet does not cause any uncomfortableness to a dweller who is near the hot air type heater.

According to the present invention, in general aspect of it, there is provided a hot air type heater which comprises, in combination: an inlet port formed in one surface part of a casing of the hot air type heater; an air blower for sucking air in the room interior into the casing through the inlet port and forming a current of air within the casing; a second heating section for heating most part of the air as sucked in from the inlet port; a second outlet port formed in the front lower surface part of the casing to blow forward hot air heated at the second heating section; a first heating section for heating the remainder of the air sucked into the casing through said inlet port to a temperature level higher than the temperature of the room air but lower than the temperature of the air heated by the second heating section; and a first outlet port formed in the upper part of the second outlet port and to blow forward slightly warm air heated at the first heating section.

The foregoing object, other objects as well as specific construction and function of the hot air type heater according to the present invention will become more apparent and understandable from the following detailed explanation thereof, when read in conjunction with the accompanying drawing.

In the drawing:

FIG. 3 is a longitudinal cross-sectional view, partly enlarged, of the outlets for hot air;

FIG. 5 is a longitudinal cross-sectional view of the floor type hot air heater according to another embodiment of the present invention.

In the following, the present invention will be described in detail in reference to a preferred embodiment as illustrated in the accompanying drawing.

Figure 1:
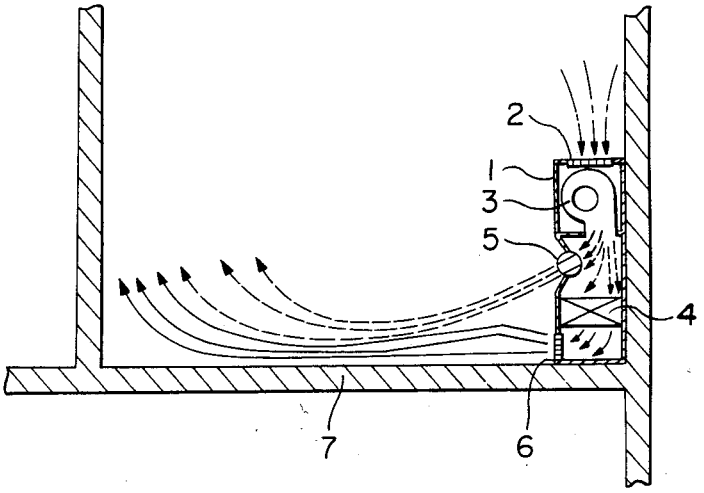
FIG. 1 is a longitudinal cross-sectional view showing a conventional floor type hot air heater and its state of air blow-out.
Figure 2:
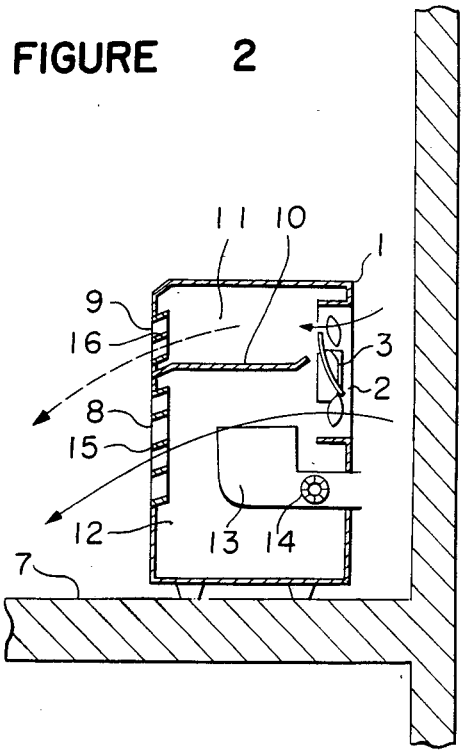
FIG. 2 is a cross-sectional view of a floor type hot air heater according to one preferred embodiment of the present invention.

Referring first to FIG. 2 showing a longitudinal cross-section of the floor type hot air heating apparatus according to one preferred embodiment of the present invention, a reference numeral 1 designates a casing or housing; a numeral 2 refers to an inlet port formed in the rear surface part of the housing 1; a reference numeral 3 denotes an air blower provided on the rear surface of the housing; and a numeral 7 refers to a floor. These parts are similar to those used in the conventional apparatus as shown in FIG. 1. A reference numeral 8 designates a second outlet port provided in the front surface of the above-mentioned housing 1; a numeral 9 refers to a first outlet port similarly provided in the front surface of the housing 1, but above the second outlet 8. Both of these outlet ports are of such a construction that air current may be blown out in the downwardly inclined direction. A reference numeral 10 designates a partition plate of a relatively good heat conductive material, which is to separate the air current toward the above-mentioned second outlet 8 and the air current flowing toward the first outlet port 9; a numeral 11 refers to an air course defined by the partition plate 10 and the casing 1; a reference numeral 12 denotes a heating chamber defined similarly by the partition plate 10 and the casing 1 below the air course 11; a numeral 13 refers to a combustion section as a heating section provided in the heating chamber 12 where kerosene or city fuel gas is used as the combustion fuel; and a reference numeral 14 designates an air blower for the combustion. Incidentally, as shown in FIG. 3, a blow-out angle A formed by the horizontal line and the blowing direction of a slightly warm air to be blown out of the first outlet port 9 is so determined that it may be greater than a blow-out angle B formed by the horizontal line and the blowing direction of a hot air to be blown out of the second outlet port 8. The determination of the blow-out angles from both outlet ports is done by respective louvers 16, 15 thereof. In this particular embodiment, the blow-out angle A is taken at 30° and the blow-out angle B is taken at 20°, as shown in FIG. 3, the former being greater by 10° than the latter.

In the thus constructed floor type hot air heater according to the present invention, when the heater starts its operation, the fuel gas or kerosene burns in the combustion section 13 with the help of air in the room interior which has been taken in by the air blower 14 for combustion. Upon this combustion of the fuel in the combustion section 13, air in the heating chamber 12 is heated. At the same time, air in the air course 11 is also heated through the partition plate 10 of a good heat conductive material. Therefore, the partition plate 10 constitutes a heating source for the air current passing through the air course 11. A part of the air in the room interior which has been introduced into the heating apparatus through its inlet port 2 formed in the rear surface of the housing 1 is converted to a high temperature air by the combustion section 13, and is blown out in the downwardly inclined direction from the second outlet port 8 toward the floor 7. Remainder of the air in the room interior passes through the air course 11 which has been warmed by the combustion section 13 by way of the partition plate 10 of relatively good heat conductivity. During its passage through the air course 11, this air is warmed to a slight degree and blown out in the downwardly inclined direction from the first outlet port 9 toward the floor 7. In this instance, the principal warm air is the high temperature air blown out of the second outlet 8. The second outlet port 8 is formed in the front part of the air current coming out of the air blower 3, while the first outlet port 9 is provided at a position which is displaced somewhat above the front part of the air current coming out of the air blower 3, and where the air current passes through this peripheral region at a somewhat reduced flowing speed. On account of this, the flow rate of the slightly warm air from the first outlet port 9 is a bit lower than the flow rate of the high temperature air blown out of the second outlet 8. Generally speaking, however, the mass of air in a certain definite space becomes heavy as the temperature therein becomes low. Consequently, the hot air which has been blown out of the second outlet 8 and tends to rise upward is suppressed by the slightly warm air which has been blown out of the first outlet 9 and has a heavier unit mass than that of the high temperature air, owing to a difference in the mass between them, whereby the hot air can reach a distant place on and along the floor 7.

Figure 4:
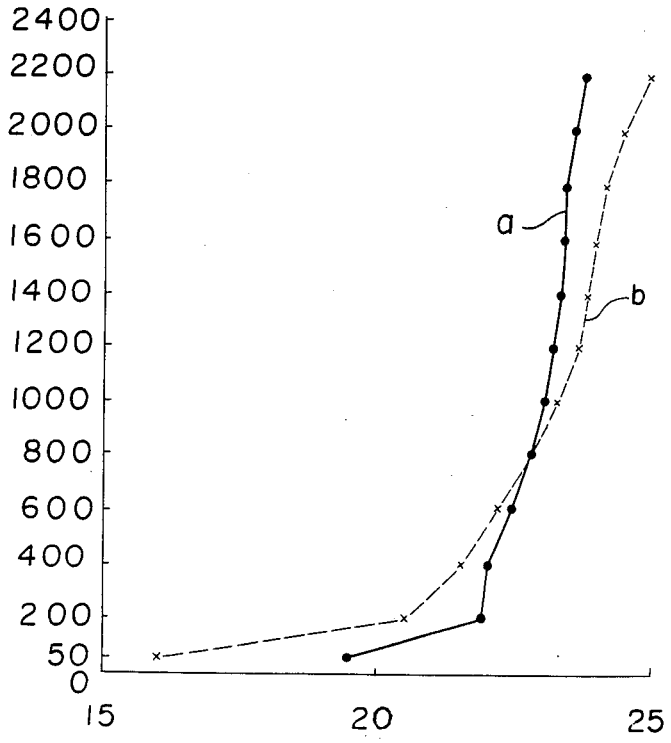
FIG. 4 is a graphical representation showing temperature distribution characteristics in the upper and lower parts of a room.

FIG. 4 is a graphical representation showing the results of measurement of the temperature distribution characteristic a in the room according to the embodiment of the present invention, and the temperature distribution characteristic b in the room according to a conventional heating apparatus. From this graphical representation, it will be seen that the temperature at and in the vicinity of the floor surface according to the present invention increases in comparison with that of the conventional heating apparatus, while the temperature in the upper part of the room lowers, hence the temperature difference between the upper and lower parts of the room becomes very small.

Even when the blow-out angle A of the first outlet port 9 and the blow-out angle B of the second outlet port 8 has no difference at all, i.e., both have the same blow-out angle, the temperature difference between both upper and lower parts of the room becomes improved to some extent. Also, even when the blow-out angle A of the first outlet port 9 is greater by 25° or more than the blow-out angle B of the second outlet port 8, the temperature difference between the upper and lower parts of the room is improved to some extent. In these cases, however, the temperature of the floor surface become high to invite deterioration of the floor material. As the results of various experiments, it has been found that appropriate range of the angular difference between the blow-out angles A and B ranges from 5° to 25°.

Further, the air to be blown out of the first outlet port 9 is the slightly warmed air, and has its flow rate lowered to some extent, so that the dweller in the room feels much less uncomfortableness due to the warm airs blown out of the second and first outlet ports 8 and 9.

In the above-described embodiment of the heating apparatus according to the present invention, explanation has been made as to a case of disposing the combustion section in the heating chamber. It should, however, be understood that a heat exchanger may be used in place of the combustion section, with which the same effect can be resulted as is the case with this particular embodiment.

Furthermore, in the foregoing explanations, the partition plate 10 has been described as having relatively good heat conductivity. Besides such partition plate, however, it may be feasible to adopt a construction such that an opening is formed in one part of a heat insulating member, through which the high temperature air in the heating chamber 12 may be introduced into the air course 11.

Moreover, in the above-described embodiment of the present invention, the heating apparatus of a floor installation type has been exemplified. Besides this, there may also be adopted a wall hanging type or a window setting type. Also, the air blower 3 has been explained for a case of its being installed on the rear wall surface of the housing 1, although it may be installed on the lower part of the housing 1 for the same resulting effect as in the embodiment of this invention.

As described in the foregoing, since the particular embodiment of the hot air type heater according to the present invention is of such construction that the first outlet port is provided on the upper part of the second outlet port for blowing out a high temperature air in the downwardly forward direction so as to enable a slightly warm air, which is lower in temperature than the high temperature air blown out of the second outlet port but higher than the temperature of the air in the room interior, to be blown out of the first outlet port in the same downwardly forward direction as that from the second outlet port, and, at the same time, since the blow-out angle A of the slightly warm air to be blown out of this first outlet port is made greater than the blow-out angle B of the high temperature air to be blown out of this second outlet port, the rising of the high temperature air can be impeded by the slightly warm air to thereby enable the high temperature air to reach a distant location on and along the floor surface, whereby remarkable improvement can be attained in the temperature difference between the upper and lower parts of the room interior; further, owing to a small difference in temperature between the high temperature air and the slightly warm air, there can be realized a living environment of relatively low feeling of draft and high comfortableness.

In the following, explanations will be given as to another embodiment of the hot air type heater according to the present invention. FIG. 5 illustrates a cross-sectional view of the floor type hot air heater of the second embodiment of the present invention, wherein those reference numerals 1 to 3 and 7 through 14 designate the same parts as in the embodimental construction shown in FIG. 2. A reference numeral 17 designates a temperature sensing unit provided in the vicinity of the inlet port 2 of the above-mentioned housing 1 for sensing a temperature of the intake air; a numeral 18 refers to a temperature sensing unit for detecting a temperature of outlet air from the first outlet port 9; a numeral 19 denotes a temperature sensing unit for detecting a combustion temperature in the combustion section 13; and a numeral 20 indicates a controller for controlling rotation of the above-mentioned air blower 3 by the input signals from the temperature sensing units 7, 18, and 19.

In the thus constructed floor type hot air heater according to the second embodiment of the present invention, when the heater starts its operation, the fuel gas or kerosene burns in the combustion section 13 with the help of air in the room interior which has been taken in by the air blower 14 for combustion. Upon this combustion of the fuel in the combustion section 13, the air in the heating chamber 12 becomes heated, and, at the same time, the air within the air course 11 is also heated through the partition plate 10 of a good heat conductive material. And, when the temperature of the temperature sensing unit 19 exceeds a predetermined temperature value, the air blower 3 starts its rotation at the minimum wind velocity by a signal from the controller 20. By the rotation of this air blower 3, a small amount of air in the room is sucked in through the inlet port 2 formed in the rear wall surface of the housing 1, while a small amount of warm air is blown out of the first and second outlet ports 9 and 8 toward the floor surface. When the temperature of the temperature sensing unit 18 becomes higher by 10° C. or more than the temperature of the temperature sensing unit 17, the air blower 3 assumes its constant speed rotation by a signal from the controller 20. The time, during which the air blower 3 rotates at the minimum wind velocity, is usually 3 minutes. By the constant speed rotation of the air blower 3, a constant quantity of air in the room is sucked in through the inlet port 2, is then heated by the combustion section 13, and finally blown out as the high temperature air from the second outlet port 8 in the downwardly forward direction toward the floor 7.

A part of the air in the room which has been sucked in through the inlet port 2 is heated by the partition plate 10 of a good heat conductive material. When the air attains a temperature of 10° C. or higher, it is blown out of the first inlet port 9 in the downwardly forward direction to the floor 7. Accordingly, this slightly warm air blown out of the first outlet port 9 acts to obstruct rising of the high temperature air blown out of the second outlet port 8, whereby the high temperature air can propagate in the distance on and along the floor surface. At the same time, there can be provided a comfortable dwelling environment with a relatively low feeling of draft owing to a temperature difference between the warm airs blown out of the first and second outlet ports 9 and 8.

By the way, the controller 20 functions to control the number of revolution of the air blower 3 by the signals from both temperature sensing units 17, 18 so that the temperature of the temperature sensing unit 18 may become higher by 10° C. or more than the temperature of the temperature sensing unit 17.

It goes without saying that the air in the air course 11 is in a heat-exchanging relationship with the combustion section 13 through the partition plate 10.

In the above-described embodiment of the heating apparatus according to the present invention, the heating apparatus of a floor installatin type has been exemplified. Besides this, there may also be adopted a wall hanging type or a window setting type. Also, the air blower 3 has been explained for a case of its being installed on the rear wall surface of the housing 1, although it may be installed on the lower part of the housing 1 for the same resulting effect as in the embodiment of this invention.

As described in the foregoing, since the second embodiment of the hot air type heater according to the present invention is of such a construction that the first outlet port is provided on the upper part of the second outlet port for blowing out a high temperature air in the downwardly forward direction so as to enable a slightly warm air, which is lower in temperature than the high temperature air blown out of the second outlet port but higher by 10° C. or more than the temperature of the air in the room interior, to be blown out of this first outlet port in the same downwardly forward direction as that from the second outlet port, thereby suppressing the tendency of the high temperature air to rise upward by this slightly warm air to enable the high temperature air to propagate in the distance on and along the floor surface, and, at the same time, since a temperature difference between the high temperature air and the slightly warm air is small, there can be realized a dwelling environment of relatively small feeling of draft and high living comfort.

So far the present invention has been described in specific details with reference to preferred embodiments thereof. It should however be noted that these embodiments are merely illustrative and not so restrictive, and that any changes and modifications may be made by those persons skilled in the art within the ambit of the invention as recited in the appended claims.

We claim:

1. A hot air type heater, which comprises in combination:

(a) an inlet port formed in one surface part of a casing for the heating apparatus;

(b) an air blower for sucking air in the room into the casing through the inlet port, and forming a current of air within the casing;

(c) a second heating section having means for heating most of the air as taken in from the inlet port;

(d) a second outlet port formed in the lower front surface part of the casing and to blow forward high temperature air heated at the second heating section;

(e) a first heating section having means for heating a remainder of the air taken into the casing through the inlet port to a temperature level higher than the temperature of the room air but lower than the temperature of the air heated by the second heating section, said means for heating said remainder of the air comprising a thermally conductive partition plate separating said first and second heating sections; and (f) a first outlet port formed in the upper part of the second outlet port and to blow forward slightly warm air heated at the first heating section.

2. The hot air type heater according to claim 1, wherein said first outlet port is given a downwardly forward blow-out angle with respect to the horizontal line so as to enable the slightly warm air to be blown out of said first outlet port to be blown in the downwardly forward direction of said casing.

3. The hot air type heater according to claim 1, wherein said second outlet port is given a downwardly forward blow-out angle with respect to the horizontal line so as to enable the high temperature air to be blown out from said second outlet port in the downwardly forward direction of said casing.

4. The hot air type heater according to claim 1, wherein said both first and second outlet ports are given a downwardly forward blow-out angle with respect to the horizontal line so as to enable both slightly warm air blown out of the first outlet port and high temperature air blown out of the second outlet port to be blown out in the downwardly forward direction of the casing.

5. The hot air type heater according to claim 4, wherein the blow-out angle of said second outlet port is made not to be greater than the blow-out angle of the first outlet port.

6. The hot air type heater according to claim 5, wherein the blow-out angle of the first outlet port is made greater by 5° to 25° than the blow-out angle of the second outlet port.

7. The hot air type heater according to claim 1, wherein the air inlet port is formed in the upper part of the casing.

8. The hot air type heater according to claim 1, wherein the flow rate of the slightly warm air from the first outlet port is made lower than the flow rate of the high temperature air from the second outlet port.

9. The hot air type heater according to claim 1, wherein a part of heat generated in said second heating section is made transmittable through said partition plate to the air passing through said first heating section.

10. The hot air type heater according to claim 9, wherein said partition plate is made of a material having good heat conductivity.

11. The hot air type heater according to claim 9, wherein a part of said partition plate has an opening formed therein.

12. The hot air type heater according to claim 1, wherein quantity of the slightly warm air from the first outlet port is made smaller than the quantity of the high temperature air from the second outlet port.

13. The hot air type heater according to claim 1, wherein the first outlet port is provided right above the second outlet port.

14. The hot air type heater according to claim 1, wherein temperature of the slightly warm air heated at the first heating section and temperature of the air in the room has a temperature difference of 10° C. or more.

15. The hot air type heater according to claim 14, wherein number of revolution of said air blower is controlled so as to make the temperature difference to be 10° C. or more.

16. A hot air type heater, which comprises in combination:

(a) an inlet port formed in one surface part of a casing for the heating apparatus;

(b) an air blower for sucking air in the room into the casing through the inlet port, and forming a current of air within said casing;

(c) a second heating section having means for heating most of the air as taken in from the inlet port;

(d) a second outlet port formed in the lower front surface part of the casing and to blow forward high temperature air heated at the second heating section;

(e) a first heating section having means for heating a remainder of the air taken into the casing through the inlet port to a temperature level higher than the temperature of the room air but lower than the temperature of the air heated by the second heating section, said means for heating the remainder of the air comprising a thermally conductive partition plate separating said first and second heating sections;

(f) a first outlet port formed in the upper part of the second outlet port and to blow forward slightly warm air heated at the first heating section;

(g) a first temperature sensing device for detecting temperature of the slightly warm air blown out of said first outlet port;

(h) a second temperature sensing device for detecting temperature of the air in the room; and (i) a controller for controlling number of revolution of said air blower on the basis of outputs from said first temperature sensing device and said second temperature sensing device so that a temperature difference between the slightly warm air blown out of the first outlet port and the air in the room becomes 10° C. or more.

17. The hot air type heater according to claim 16, wherein said first temperature sensing device is provided in the vicinity of said first outlet port.

18. The hot air type heater according to claim 17, wherein said second temperature sensing device is provided in the vicinity of the air inlet port.

* * * * *